US011085279B2

(12) United States Patent
Huang et al.

(10) Patent No.: US 11,085,279 B2
(45) Date of Patent: Aug. 10, 2021

(54) STRESS-TRANSFER METHOD IN TUNNEL WITH HIGH GROUND PRESSURE BASED ON FRACTURING RING

(71) Applicants: China University of Mining and Technology, Suzhou (CN); XUZHOU USURE MINING TECHNOLOGY CO., LTD, Suzhou (CN)

(72) Inventors: Bingxiang Huang, Jiangsu (CN); Jiangwei Liu, Jiangsu (CN); Xinglong Zhao, Jiangsu (CN); Shuliang Chen, Jiangsu (CN)

(73) Assignees: China University of Mining and Technology, Jiangsu (CN); XUZHOU USURE MINING TECHNOLOGY CO., LTD, Jiangsu (CN)

( * ) Notice: Subject to any disclaimer, the term of this patent is extended or adjusted under 35 U.S.C. 154(b) by 29 days.

(21) Appl. No.: 16/463,358

(22) PCT Filed: Sep. 30, 2017

(86) PCT No.: PCT/CN2017/104696
§ 371 (c)(1),
(2) Date: May 22, 2019

(87) PCT Pub. No.: WO2018/205492
PCT Pub. Date: Nov. 15, 2018

(65) Prior Publication Data

US 2019/0316454 A1 Oct. 17, 2019

(30) Foreign Application Priority Data

May 10, 2017 (CN) ..... 201710324648.8

(51) Int. Cl.
*E21B 43/26* (2006.01)
*E21F 17/00* (2006.01)
*E21D 9/00* (2006.01)

(52) U.S. Cl.
CPC ..... *E21B 43/26* (2013.01); *E21F 17/00* (2013.01); *E21D 9/00* (2013.01)

(58) Field of Classification Search
CPC ..... E21B 43/26; E21D 9/00; E21F 17/00
See application file for complete search history.

(56) References Cited

U.S. PATENT DOCUMENTS 4,017,121 A * 4/1977 Trent ..... E21C 37/12 299/11
4,230,368 A * 10/1980 Cleary, Jr. ..... E02F 1/00 166/259

(Continued)

FOREIGN PATENT DOCUMENTS

CN 102518471 6/2012
CN 103726872 4/2014

(Continued)

OTHER PUBLICATIONS

"International Search Report (Form PCT/ISA/210) of PCT/CN2017/104696," dated Feb. 6, 2018, with English translation thereof, pp. 1-5.

*Primary Examiner* — Aaron L Lembo
(74) *Attorney, Agent, or Firm* — JCIPRNET

(57) ABSTRACT

A stress-transfer method in tunnel with high ground pressure based on fracturing ring. According to the stress source of the tunnel, fracturing by drilling holes to form artificial weaken zones in surrounding rocks, that's named fracturing ring. The fracturing ring is the weaken zone with some width, whose inner boundary is the protective circle. The fracturing ring with small width is called the cutting and interruption circle and the cutting or interruption arc. The (Continued)

radius of the protective circle is determined by setting a certain width of safety coal pillar barriers at the edge of a support body. The radius of the fracturing ring is determined by the surrounding rock structure and the stress conditions as well as the construction technology. Usually, the higher the stress, the wider the radius of the fracturing ring. The cutting and interruption circle or arc could cut off all of the targeted rock which transmits the stress.

10 Claims, 10 Drawing Sheets

(56) References Cited

U.S. PATENT DOCUMENTS

| | | | | |
|---|---|---|---|---|
| 4,245,699 | A | 1/1981 | Steeman | |
| 5,147,111 | A * | 9/1992 | Montgomery | E21B 43/006 166/308.1 |
| 8,833,474 | B2 * | 9/2014 | Enis | E21B 41/0064 166/308.1 |
| 9,068,449 | B2 * | 6/2015 | Surjaatmadja | E21B 43/26 |
| 9,121,272 | B2 * | 9/2015 | Potapenko | E21B 43/26 |
| 9,273,553 | B2 * | 3/2016 | Gray | E21B 43/26 |
| 9,995,139 | B2 * | 6/2018 | Chu | E21D 9/006 |
| 10,472,963 | B2 * | 11/2019 | Lin | E21F 7/00 |
| 2013/0032350 | A1 * | 2/2013 | Potapenko | E21B 43/26 166/308.1 |
| 2013/0206412 | A1 * | 8/2013 | Dale | E21B 43/26 166/298 |
| 2014/0076557 | A1 * | 3/2014 | Surjaatmadja | E21B 43/26 166/280.1 |
| 2014/0117739 | A1 * | 5/2014 | Gray | E21B 43/261 299/10 |

FOREIGN PATENT DOCUMENTS

| | | | |
|---|---|---|---|
| CN | 104763432 | | 7/2015 |
| CN | 104482817 | B * | 10/2015 |
| CN | 106401609 | | 2/2017 |
| CN | 107083961 | | 8/2017 |
| CN | 108643924 | * | 10/2018 |
| WO | 2012174586 | | 12/2012 |

* cited by examiner

STRESS-TRANSFER METHOD IN TUNNEL WITH HIGH GROUND PRESSURE BASED ON FRACTURING RING

CROSS-REFERENCE TO RELATED APPLICATION

This is a 371 application of the International PCT application serial no. PCT/CN2017/104696, filed on Sep. 30, 2017, which claims the priority benefits of China Application No. 201710324648.8, filed on May 10, 2017. The entirety of each of the above-mentioned patent applications is hereby incorporated by reference herein and made a part of this specification.

FIELD OF THE INVENTION

This invention relates to a stress-transfer method in tunnel with high ground pressure, which can form an artificial weaken zone in the surrounding rock of a tunnel, namely, "fracturing ring". The concentrated high-stress in the surrounding rock of the tunnel can be transferred to a safe region that far-away the tunnel by unloading, stress-interruption and stress-yielding, which proactively reduces the stress in surrounding rock of the tunnel to a low manageable range. An added artificial weakened zone can absorb energy shock wave and control the influence of the deformation of surrounding rock in tunnel which caused by loading.

DESCRIPTION OF RELATED ART

The reason of instability of tunnel surrounding rock in terms of generation mechanism is mainly divided into three aspects:

① The High In-Situ Stress

Deep underground mining is becoming popular and normal in more and more mines especially coal mines whose buried depth may exceed 1000 m. The high stress usually concentrates in the tunnel which is near geological structure zone. Also, poor integrity of surrounding rock increases the in-situ stress locally or wholly, which can caused the behavior of strong in-situ stress such as rock burst, coal bump, and gas outburst et. al.

② The Mining Disturbance

Mining sequence inevitably leave behind isolated/semi-detached working face. Also, the stopping high gassy working face needing to release methane for a long time becomes isolated working face. The protective coal pillar of upper working face would concentrate the high stress and additionally load it on the lower coal seam in adjacent coal seams mining.

The superposition of dynamic load and static load and concentration of stress may be induced during the tunnel maintenance by the influence of its own face, neighbor face, upper face, lower face of steep seam, increasing the rate of instability failure and the risk of rock burst and coal bump. During the tunnel excavation, the surrounding rock is being disturbed, which as well as the dynamic mining pressure of neighbor faces makes the roof movement more active and the ground pressure behavior stronger.

③ The Mechanical Properties of Surrounding Rock

The mechanical properties of surrounding rock are important for the stability of tunnel. In metal mines and non-metal mines, a large area of hard roof of gob would always be overhung, therewith, whose dead load and the overburden load are transferred to the pillar and the roof of tunnel, increasing the loads of these zones. Secondly, the hard roof with the characters of high-strength and big elastic modulus, which is the ideal elastic energy storage body, could provide the necessary energy for the strong ground pressure behavior. Thirdly, most of the roof is made up of sedimentary rock which is characterized of good integrality, high stiffness and little deformation and is the ideal medium for the stress propagation. Such roof could transmit the high stress in the distance to the critically abutment area under the roof such as pillar, trending to induce the stress disturbance of the tunnel next to the working face.

In the metal mines and coal mines who have the burst-prone rock and coal, the burst would happen when the concentrated stress increases up to a value which is not less than the critical bucking strength. Similarly, the coal and gas outburst would happen. 80% of the tunnels are the coal tunnels in coal mines at present. Special emphasis is that almost all the head entry and tail entry are coal tunnel. There is a big risk of coal and gas outburst in coal tunnel during the shaft and drift development and recovery.

Concentrated high-stress and the dynamic disasters such as coal bump and rock burst are the technical obstacles of the ground control in the tunnel. The key roles are the mechanical properties of rock and stress condition. Many research showed that the slope stress distribution and dynamic disasters are closely related to the ambient stress condition. Reducing the stress of surrounding rock could effectively help to reduce the probability and severity of surrounding rock deformation and dynamic disasters. Thus, the key of ground control is the control of surrounding rock stress distribution in the tunnel. Surrounding rock fracturing in the tunnel could create crack network, forming weaken zone and reducing the stress changing the stress state of surrounding rock. So, it is an effective way to the control the strong ground pressure behavior in deep mines and the tunnel with the characters of serious deformation and dynamic disasters.

There is a prior art of ground high-pressure control in the tunnel near the gob by hydraulic fracturing. Firstly, the strata of hard roof are targeted according to the borehole columnar section of the working face. Secondly, the hole is drilled for the control of the front abutment pressure and the side abutment pressure, the grooving and the hydraulic cutting could be conducted at the bottom of the borehole to guide the direction of the crack initiation. Thirdly, the hydraulic fracturing is implemented to weaken the hard roof or cut it off along the designed direction, which transfer the stress and weaken the surrounding rock, inducing the front and side abutment stress of tunnel next to the gob. Weaken zone inside the surrounding rock could absorb or weaken the shock stress wave, which could avoid the dynamic disasters like rock burst caused by the sudden roof snap and control the serious deformation. This art is suitable for the ground high-stress control in the tunnel near the working face with the hard roof as well as the tunnels cross with the excavating tunnels of the adjacent working face.

The above art intrinsically cut off the hard roof whose one side or two sizes are overhanging along the designed direction and is not suitable to handle the problems of the isolated/semidetached working face. The tunnel, during the construction and maintenance, could be influenced by the mining-induced stress of serviced working face and surrounding working face and the value of the stress could be increased remarkably. Especially, when the excavation face of tunnel meets across with the extraction working face, the dynamic load factor could reach up to a high value which is several times or even more than ten times than it used be with a strong ground pressure behavior. So, this art is not suitable for the deep mines which are puzzled by the high stress and the mines with a high tectonic stress. Some of the driving faces have the risk of dynamic disaster, which are not suitable to use the above art to handle them because the above art could not cut off the stress. Additionally, the prior art puts forward the opinions of that the weaken zones in the surrounding rock could absorb and subside the shock wave to avoid the dynamic disasters like rock burst caused by the sudden subsidence of hard roof. However, such effect of the weaken zone could not be controlled or adjusted for specific engineering purpose.

SUMMARY OF INVENTION

Technical Problem

To overcome the defects of the prior art, the invention provides a stress-transfer method in tunnel with high ground pressure on fractured ring to avoid the serious deformation and dynamic disasters like rock burst caused by the high ground stress. The artificial weaken zone can absorb and subside the shock wave, whose process can be controlled.

Technical Solution

The technical solution of the invention for solving the problem is: a stress-transfer method in tunnel with high ground pressure on fractured ring. The technical solution of the invention is characterized in that: firstly, according to the stress conditions of the tunnel, a stress source which has caused or will cause the strong ground pressure in the tunnel should be targeted; secondly, a hole targeting to the stress source drilled to implement fracturing, so that, a circle of artificial weaken zones are created in the surrounding rock of tunnel, namely, "fracturing ring"; a radius of the fracturing ring is determined by setting a certain width of the safety coal pillar barriers at the edge of a support body; the radius of the fracturing ring is determined by the surrounding rock structure and in-situ stress conditions as well as the construction technology. The higher the in-situ stress is, the wider the radius of the fracturing ring.

Further, to get the relatively wide fracturing ring, the hole is drilled and the fracturing is performed in the entire hole; to get the relatively narrow fracturing ring, that is, "the cutting and interruption circle", the hole is drilled and the pre-slotting and fracturing are conducted at the bottom of the hole.

Further, the fracturing ring can be changed basing on different requirements: when it needs to interrupt the transmission of concentrated high-stress or mining-induced stress towards the tunnel, the hole is drilled in the targeted surrounding rock where the stress is concentrated. The disc area which is perpendicular to the hole and is at the bottom of the hole is located in the targeted rocks. The targeted rocks could be the roof, the floor, the pillar, the sidewall or combination thereof. The radius of the fracturing ring can be adjusted by changing the fracturing length of hole. If the radius of the fracturing ring is small enough, the fracturing ring may be approximated by a fracturing circle which is named as "cutting and interruption circle". The cutting and interruption circle could be used to proactively cut off the mining-induced stress and the high stress transmitted from the tectonic zones and the far-field in the deep mines, achieving the stress-interruption. When it needs to cut off the hard hanging roof, the needed radius of the fracturing ring is relatively small and only part of the ring needs to be fractured which could be called "cutting and interruption arch". The cutting and interruption arch could be used to proactively cut off the hard overhanging roof, achieving the unloading for the tunnel.

Further, when there is one or multilayer of hard rock stratum in the roof, the hole is drilled at an angle into the hard roof, the end part of the hole in the horizontal direction reaches to the pillar with certain distance and the pillar is set with a certain width between the tunnel and the gob, the end part of the hole in the vertical direction is up to the center of the hard roof. Pre-slotting is performed and the fracturing is conducted in the hole according to the reasonable design. The preset slot induces the direction of the fracture initiation. The fracture propagates and extend along several directions to form a fracture plane consisting of one or multiple cracks whose center is the hole and whose length depends on the equipment and the design. Rows of holes are set along the tunnel axis at a certain interval to be drilled and fractured. The cracks created by fracturing may connect with each other or not. The hard roof is wholly cut off and the high-stress is removed from the origin.

Some roofs may be particularly hard in some mines. They would hang there and don't want to collapse after recovery. Such roofs could be fractured after recovery. Also, such roof could be fractured before the recovery according to the reasonable design to form the fracture plane and the fractured roofs would collapse under the influence of gravity by themselves after the recovery, avoiding the hard roof-hanging.

The cutting and interruption circle and the cutting and interruption line could cut off all of the targeted rock which transmits the stress. Actually, the cutting and interruption line is a section which is created by the fracturing which cut off the hard roof. It is called breaking roof line. The optimum position of the breaking roof line is the boundary line between the plastic zone and the crushing zone of the coal pillar.

Further, both long holes and short holes which are set in rows along the axis of the tunnel are drilled into the hard hanging roof. The vertical component of both short holes and the long holes are up to the center of the hard roof. Among others, the long holes whose angle of elevation is small and whose end is closer to the side of gob but more far away from the tunnel have a big length. Relatively, the short holes whose angle of elevation is big and whose end is closer to the tunnel but more far away from side of the gob have a small length. The long holes whose ends are set in linear layout are the main fracturing holes. Similarly, the short holes whose end are set in linear layout are the assisting fracturing holes. All the holes are continuously set with some space along the tunnel in the order of the long-the short-the long-the short. The pre-slotting is performed firstly and the fracturing is conducted secondly in the holes. The slotting and the fracturing could create a fracture arc which is called 'the long hole fracture arc' in the main fracturing holes and 'the short holes fracturing arc' in the assisting fracturing holes. The long hole fracture arc is used to cut off the rock strata of the hard roof and the short hole fracture arc is utilized to prevent the impact energy caused by the break of the roof from influencing the tunnel.

Further, when there are two layers of hard roof or multilayer of hard roof, a group of holes is respectively constructed to fracture each layer of them. The number of the borehole layers depends on the number of roof layers and it is the same group of borehole arrangement parameters for the boreholes prepared for the same layer of hard roof. Similarly, the vertical component of the boreholes is up the center of the hard roof. Such slicing fracturing for the multilayer of hard roof make the entire hard roof form layered failure.

Further, the holes are drilled in the tunnel, into the targeted rocks which transmit the stress or the entire surrounding rocks towards the direction of the roof, the floor and the tunnel's sides Then, the hole-sealing, the pre-slotting and the fracturing at the bottom of the hole were orderly conducted to form petty fracture zone or fracture plane, namely, the cutting and interruption circle. The cutting and interruption circle could stop the high-stress from transmitting towards the tunnel to achieve the stress-transfer. The job could be conducted at the early stage of tunnel born, before the influence of the front abutment pressure on the tunnel or in the tunnel influenced by the tectonic high-stress.

Further, the holes are drilled into the targeted rocks which transmit the stress or the entire surrounding rocks from the roof, the floor and the tunnel's sides in the tunnel. Then, the hole-sealing and the fracturing in the whole hole were orderly conducted to form the fracture ring with some width. The fracture ring could help to transmit the high stress to the deeper zones which is out of the fracture ring to form a protective circle. The tunnel and the integrated surrounding rock of the protective circle is in the low-stress zone to avoid the high-stress. The job could be conducted in the tunnel which influenced by the high-stress of the deep mine or the tectonic high-stress.

Further, the holes on the tunnel's sides are drilled to weaken the zones within the fracture circle in the completed tunnel. Also, fan drilling on the tunnel driving face could be conducted in the direction of the heading to weaken the front zones within the fracture ring. A protective rock/coal pillar with the width of 3~10 meters are reserved at the borehole section near the tunnel when fracturing. The width of the protective pillar is dependent on the condition of surrounding rock, surrounding in-situ stress, support range and strength as well as the tunnel parameters.

Advantageous Effect

The fracturing methods includes hydraulic fracturing, gas fracturing, CO2 phase-transition fracturing, electromagnetic pulse fracturing, capsule-expanding fracturing and bolts-expanding mechanical fracturing. The beneficial effect: the method can form an artificial weaken zone in the surrounding rock of the tunnel, that is, "fracturing ring". The concentrated high-stress near tunnel can be transferred to the far-away non-threating area by unloading, stress-interruption and stress-yielding, which proactively reduces the stress to a low manageable range. The extra artificial weakened zone can absorb energy shock wave and control the deformation of surrounding rock.

BRIEF DESCRIPTION OF THE DRAWINGS

The invention will now be further described by way of drawings and embodiments.

FIG. 2-1 shows the stress condition before the fracturing of the roof stress interruption embodiment.

FIG. 2-2 shows the stress condition after the fracturing of the roof stress interruption embodiment.

FIG. 2-3 shows the stress condition before the fracturing of the floor tectonic stress interruption embodiment.

FIG. 2-4 shows the stress condition after the fracturing of the floor tectonic stress interruption embodiment.

FIG. 2-5 shows the stress condition before the fracturing of the floor mining-induced stress interruption embodiment.

FIG. 2-6 shows the stress condition after the fracturing of the floor mining-induced stress interruption embodiment.

FIG. 3-1 shows the stress condition before cutting off the hard hanging roof.

FIG. 3-2 shows the stress condition after cutting off the hard hanging roof.

FIG. 4 shows the optimum location of the 'cutting and interruption arch' for the hard hanging roof.

FIG. 5-1 shows the sectional view of the long-short borehole cutting off conduction embodiment before fracturing.

FIG. 5-2 shows the plan view of the long-short borehole cutting off conduction embodiment before fracturing.

FIG. 6-1 shows the sectional view of the long-short borehole cutting off conduction embodiment after fracturing.

FIG. 6-2 shows the plan view of the long-short borehole cutting off conduction embodiment after fracturing.

FIG. 7-1 shows the stress distribution before the group fracturing-cutting for a multilayer hard roof.

FIG. 7-2 shows the stress distribution after the group fracturing-cutting for a multilayer hard roof.

Figure 1:
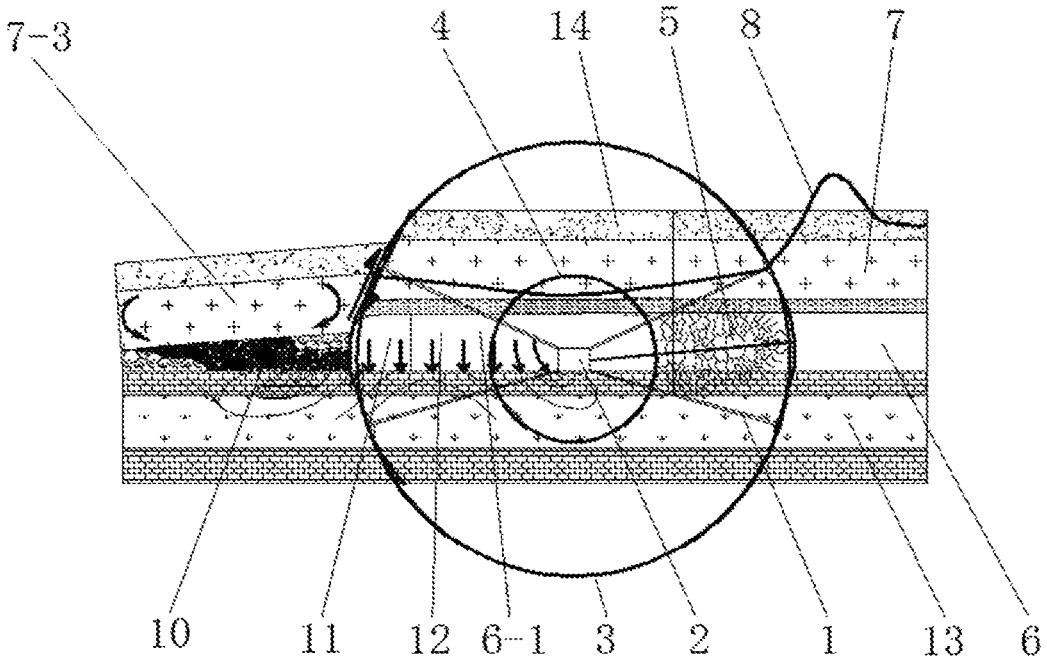
FIG. 1 shows the idea model of the stress transfer by fracturing ring.

In the drawings: 1, boreholes; 1-1, high level borehole; 1-2, low level boreholes; 1-3, long borehole; 1-4, short borehole; 2, tunnel; 2-1, entry meeting with the neighbor recovery face; 2-2, gob side entry; 2.3, completed tunnel; 2.4, excavating tunnel; 3, outer boundary of fracturing ring; 4, protective circle; 4-1, protective line; 5 fracturing ring; 5-1, fracturing zone; 6, coal seam; 6-1, protective coal pillar; 7, roof; 7-1, hard roof; 7-2, hard hanging roof; 7-3, cutting off the hanging roof; 7-4, high level hard roof; 7-5, low level hard roof; 8, abutment pressure; 8-1, high stress; 9, cutting and interruption arch; 10, gob; 11, broken zone; 12, plastic zone; 13, floor; 14, overlying strata; 15, broken plane; 16 stopping working face; 17, roof-broken line; 18 main roof; 19, immediate roof.

DETAILED DESCRIPTION OF THE INVENTION

To make the purpose, the technical solution and the advantages of the invention's embodiment much clearer, the technical solution of the invention's embodiment will be clearly and fully described by the way of the embodiment's drawings. Obviously, the described embodiment is a few part of the embodiments, not all of the embodiments. Basing on the embodiment of this invention, other embodiments which are made by those skilled in the art without departing from the spirit and scope of the invention described herein should belong to the protection scope of the invention.

The strong behavior in the tunnel is mainly related to the ambient in-situ stress. Reducing the surrounding rock stress of the tunnel can effectively reduce the probability and the intensity of the surrounding rock deformation and the dynamic disasters. The stress control actually transfers the high stress to other zones to reduce the stress of the targeted zones to a controllable value because the high stress is not able to be vanished. The in-situ stress causing the tunnel instability in terms of the source can be divided into three parts: the roof stress, the same layer stress (the face and the tunnel's sides) and the floor stress. Referring to the FIG. 1, this invention provides the tunnel high stress control idea by using fracturing to transfer the stress. The idea can be concluded that: (1) firstly, the load on the surrounding rock should be maximally whittled down from the source. The fracturing to the targeted strata could form the cutting and interruption arch to cut off the hard roof, which transmit the high stress caused by the hanging hard roof to the gob area; (2) the propagation path by which the mining induced stress or the tectonic stress is transferred to the tunnel is artificially cut off. The fracturing to the targeted strata form the cutting and interruption arch which can transfer the mining induced high stress to the zones far away from the tunnel. Also, the propagation path by which the high stress of the deep mine is transferred to the tunnel is artificially cut off as soon as the tunnel is completed. The connection and intersection of the propagating cracks caused by the fracturing form the cutting and interruption circle, which could stop the high stress of the far field from propagating to the tunnel and transfer the high stress to the filed far from the tunnel. (3) the fracturing to the zones of the fracturing ring could artificially form the weaken zone, which transfers the high stress concentrating on the surrounding rock of tunnel to a safe zone which is far from the tunnel. Such stress transfer keeps the stress of the tunnel's surrounding rock a low and controllable value. The added artificial weaken zones can slow down and absorb the impact energy. So the influence of the load to the surrounding rock deformation could be controlled.

For the high stress situation caused by the hard hanging roof in the gob after the recovery, on the one hand, the directional fracturing should be conducted to cut off the hanging roof; on the other hand, the pre-fracturing to the hard roof should be conducted to alleviate burdens. For the tunnels especially the tunnel heading the neighbor recovery mining face which are badly influenced by the high stress from the deep far filed, the mining induced stress from the its own face and the nearby face as well as the tunnels which are close to the fold axis and the fault structure, the directional fracturing to the surrounding rock should be conducted to cut off the stress propagation path to interrupt the stress. For the tunnel which cannot alleviate burden further and has been in the state of high stress, the fracturing to the surrounding rock in the tunnel or the heading face in the range of the fracturing ring should be conducted to form the weaken energy absorption zones, which guide the high stress to the far deeper zone.

Therefore, the process of the invention could be summed up as: the interruption, the burden-alleviating+interruption, or the burden-alleviating+interruption+stress-yielding. The specific application is as follow:

1. Stress Relief (Unloading)

Figures 1, 2:
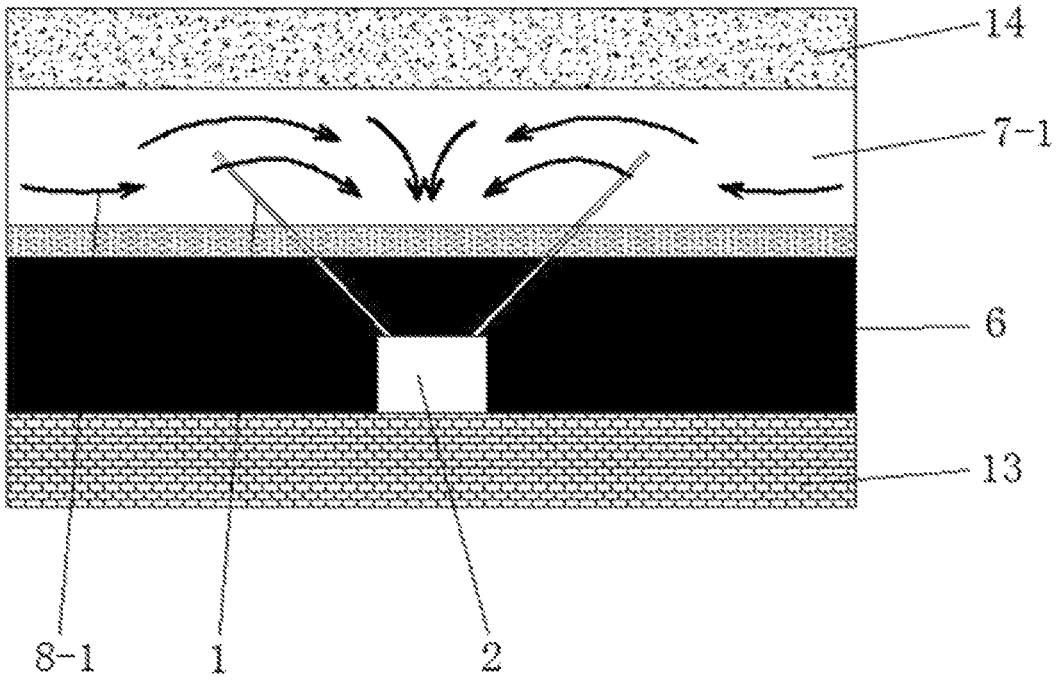
Figure 2:
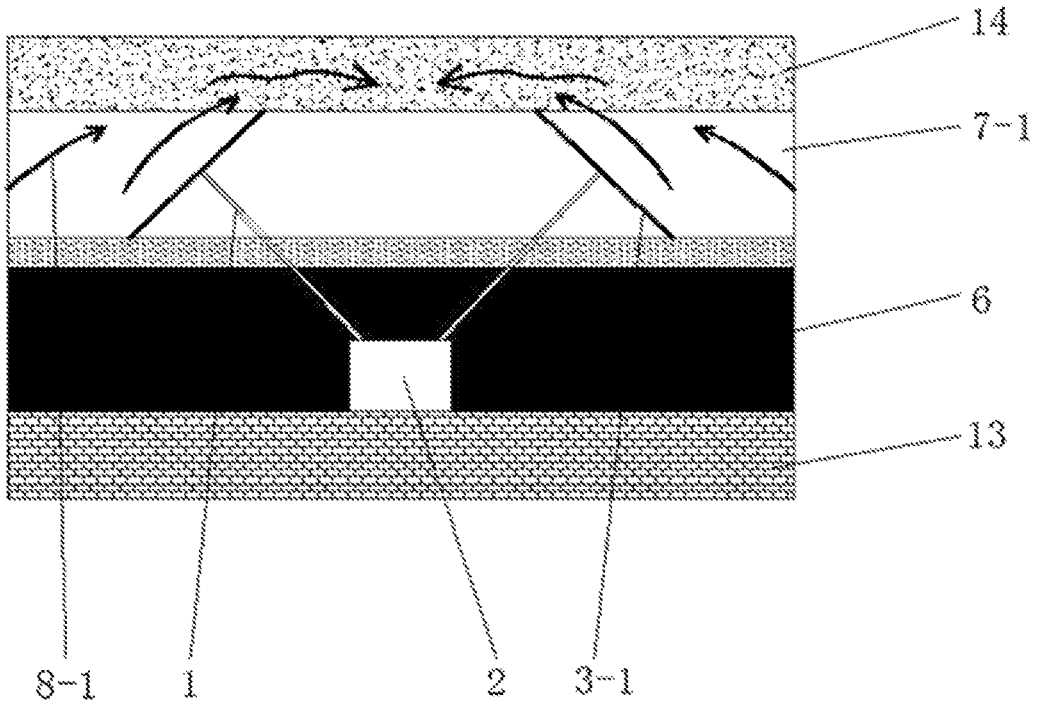
Figures 2, 3:
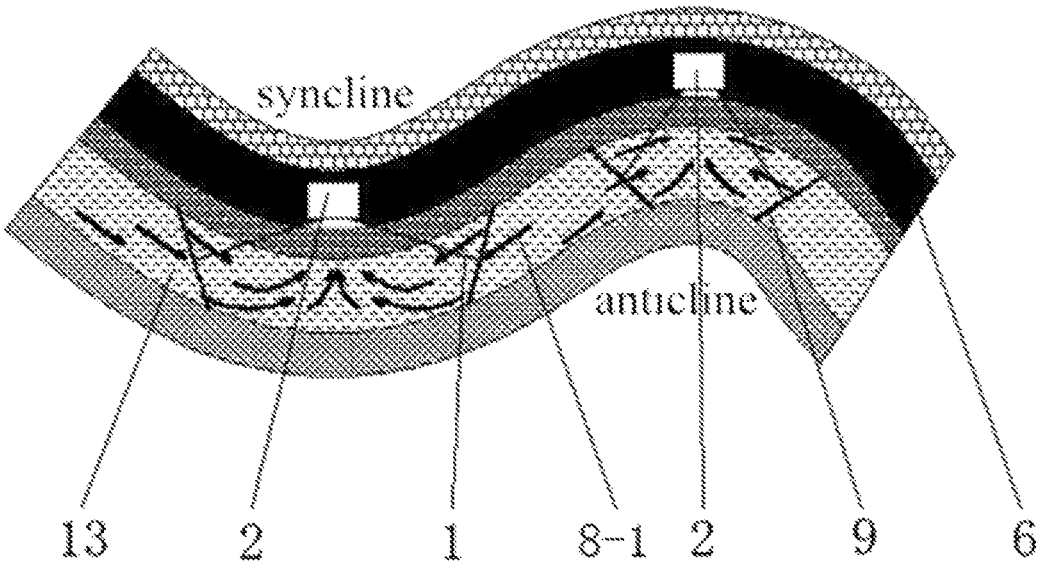

Referring FIG. 1, FIG. 3-1 and FIG. 3-2, a large area of roof would hang and not intend to crack, which is easy to form cantilever beam. The huge load of the overlying strata would transfer to the zone above the tunnel and give the surrounding rock of the tunnel a heavy burden, which make the tunnel in the state of high stress. For such kind of stress source, the load should be maximally whittled down by the fracturing to the hard roof which could form artificial broken plane. The boreholes should be drilled into the hard roof in the tunnel, whose horizontal component is reach to the coal pillar and whose vertical component is up to the center of the hard roof. The pre-slotting and the fracturing are orderly conducted in the boreholes. The fractures caused by the fracturing propagate and extend along the guide groove. And they connect with each other to form a continuous broken plane. Also the continuity of the broken plane could be artificially controlled to form an oval weaken structure with different damage so that the hard hanging roof could be cut off entirely and the high stress could be remove from the source. Firstly, the hard-to-caving hanging roof should be cut off and reelingly sink to the gob along which the overlying strata reelingly sink to the gob so that the huge load could be reduced and the stress of the tunnel and the coal pillar could fall back to a controllable rang. Secondly, the artificial control to the continuity of the broken plane could form a weaken structure zone which meet the requirement of the design strength. The weaken structure zones which could absorb the impact energy could be used to control the roof breaking intensity to achieve safety unloading and reduce the secondary disaster risk like gas explosion. Thirdly, the fracture plane along which the hanging roof is cut off is the part of the cutting and interruption circle thus is called the cutting and interruption arch. The position of the cutting and the interruption arch is key of the technology. The proper alternate interior roof-broken positions is helpful for that partial coal pillars were overwhelmed to be a cushion by the falling roof. The broken roof subsidence is buffered which reduces the risk of secondary disaster caused by the violent roof broken.

Referring to the FIG. 3-1, FIG. 3-2 and FIG. 4, due to the influence of the hard hanging roof the integrated strength of the pillars in which there is fracture zone and plastic zone near the gob side is small. When the roof-broken position is too closer to the gob and is not interlaced with the coal pillars a large area of the roof would slide or cave rapidly without the support and buffer of the coal pillar, which might form the impact load, induce dynamic disasters and even squeeze out the gas instantaneously. Sometimes, the effect of the directional fracturing can't be guaranteed due to the bed bending separation of hanging roof rock mass. There is a maximum bending deflection for the cantilever beam of the hard roof of which the position is usually related to the width of the fracture zone and the plastic zone as well as the stiffness of the coal pillar and the roof rocks. When the fracturing position is appropriately interlaced with the coal pillar on the horizontal plane, the breaking roof on the coal pillar make the load from the overburden strata increase, which could gradually increase the width of the pillar fracture zone under the hard roof and reduce the width of the effective abutment coal pillar. When the width of the pillar fracture zone under the roof is up to a proper value, the broken hanging roof would rotate to the gob slowly to further damage the plastic zone of the pillar below. Finally, the broken roof entirely slides into the gob and tightly connect with the coal gangue to form the stable abutment body. So, the load of the roof could be removed and the influence of the impact load could be avoided. When the roof-broken position is properly interlaced with the coal pillar, the curvature and the tension force of the roof increasing, which is effectively helpful to the effect of the fracturing roof-cutting. The roof-broken position is designed to avoid the bed separation zone of the roof above the gob, which could make sure the fracturing effect in the view of construction. Of course, the interlaced position could not be too far from the gob, or the broken roof could not cave to contact the gangue. So, there is an optimum position of the roof-cutting line for the directional fracturing of hard hanging roof in theory. The directional fracturing g position in practice is determined considering both the field construction conditions and the fracture propagation law of the directional fracturing to make an ideals stress situation of the gob side entry.

It would be specially mentioned that the caving roof would certainly squeeze and damage part of the protective coal pillar closing to the gob side, which would induce the integrity and width of the protective coal pillar. The stress on the coal pillar and the tunnel would be transferred against the gob. So, enough attention should be focused on the integrity of the gob side entry and the variation of stress after the roof breaking.

There would be both compressive failure and shear failure in the coal pillar zone near the gob side when the broken roof sliding and caving. When the caving roof squeeze the coal pillar near the gob side to break, it is the compressive failure. When the sliding roof shear coal pillar near the gob side to break, it is the shear failure. Thus, both the compressive strength and the shear strength should be considered. That is, the total load Q that the overlying hanging rocks exert to the coal pillar should not less than the load FN that the pillar could afford; the shear stress $\tau 1$ that the overlying hanging rocks exert to the coal pillar should not less than the shear strength $\tau 0$ of the coal pillar.

Usually, a relatively smaller value among the calculation results is chose as the optimum roof-broken position so that the broken hard roof could smoothly cave or slide into the gob in the two failure and there are enough width of the effective abutment coal pillar and integrity of the tunnel surrounding rock.

Combining the compressive failure and the shear failure, the position of top-broken line in the engineering of directional hydraulic fracturing to the hard hanging roof.

Figures 2, 3, 4:
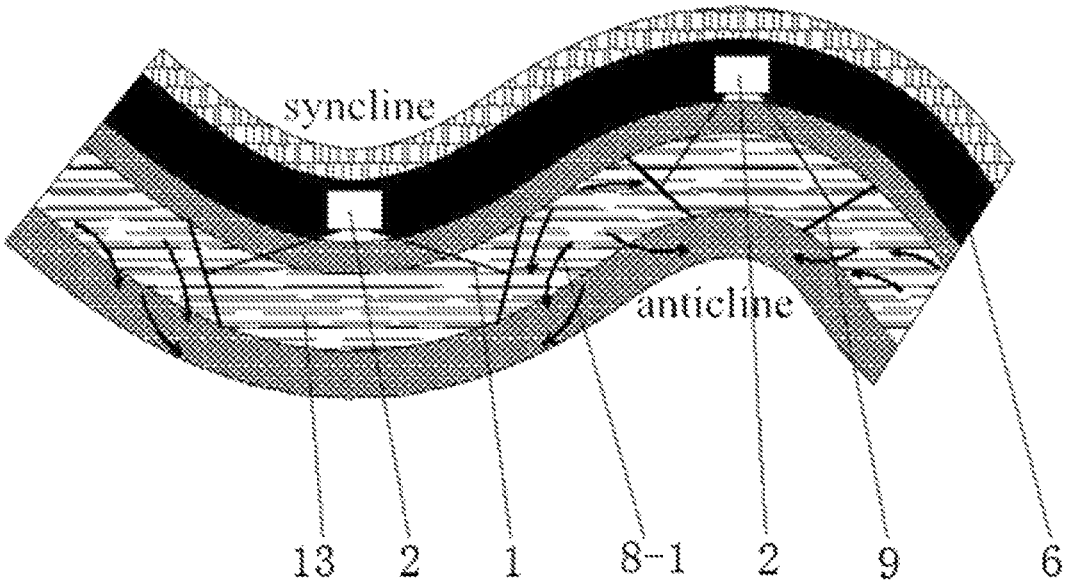
Figures 2, 3, 4, 5:
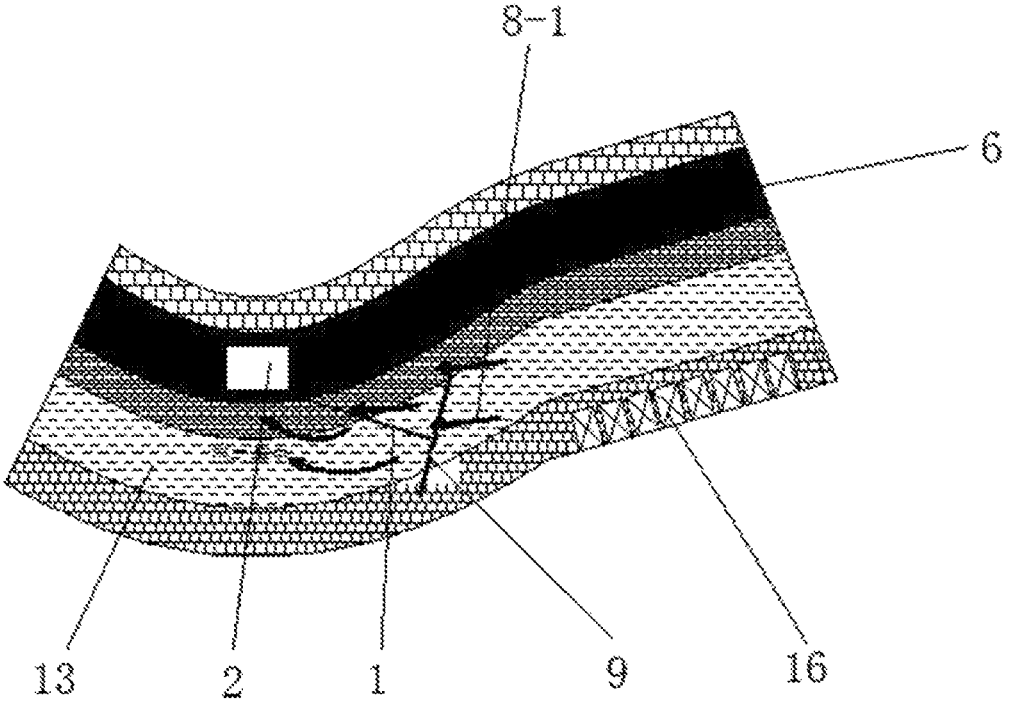
Figures 2, 3, 4, 5, 6:
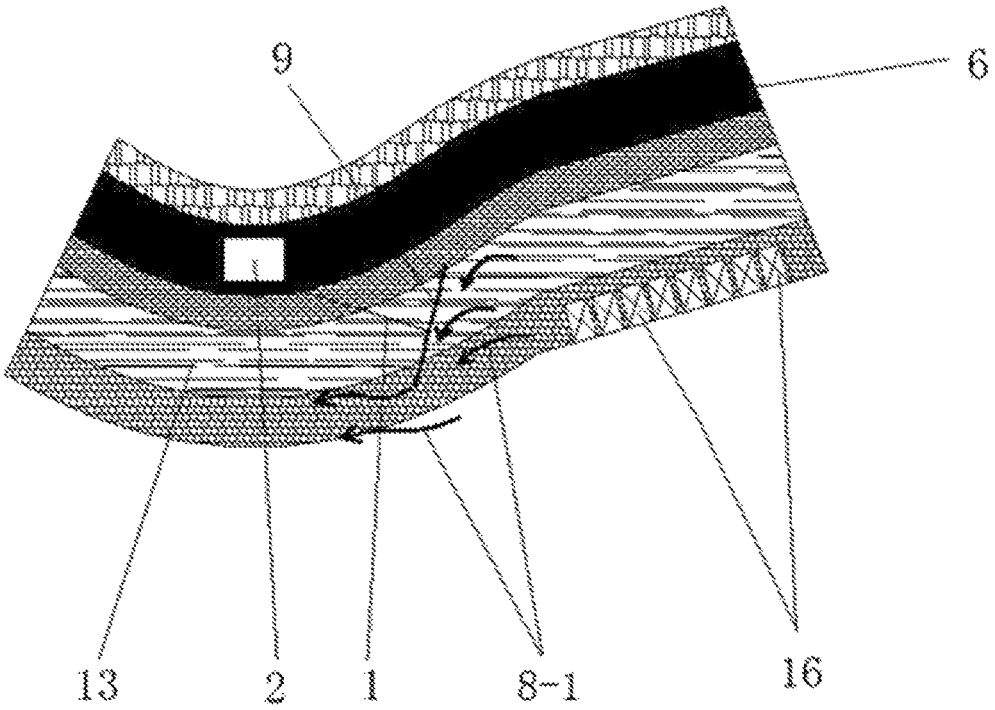
Figures 1, 3:
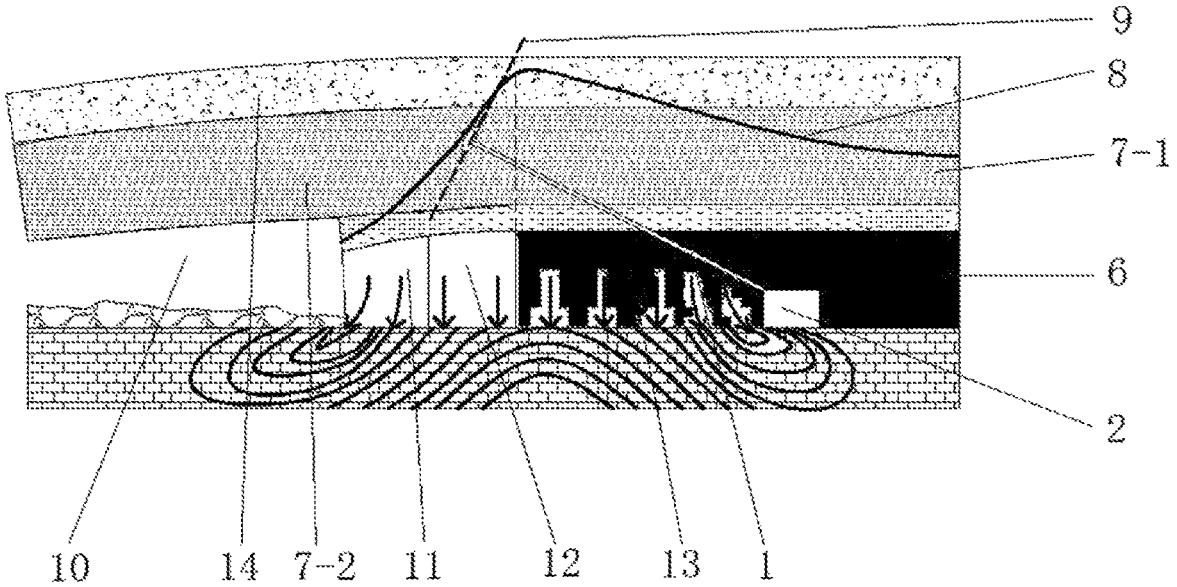
Figures 2, 3:
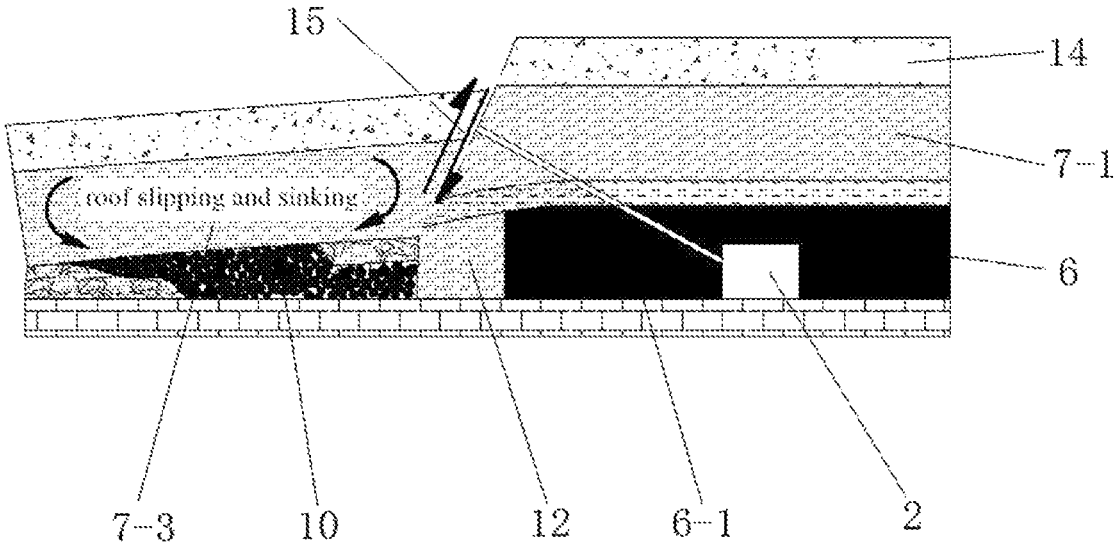
Figure 4:
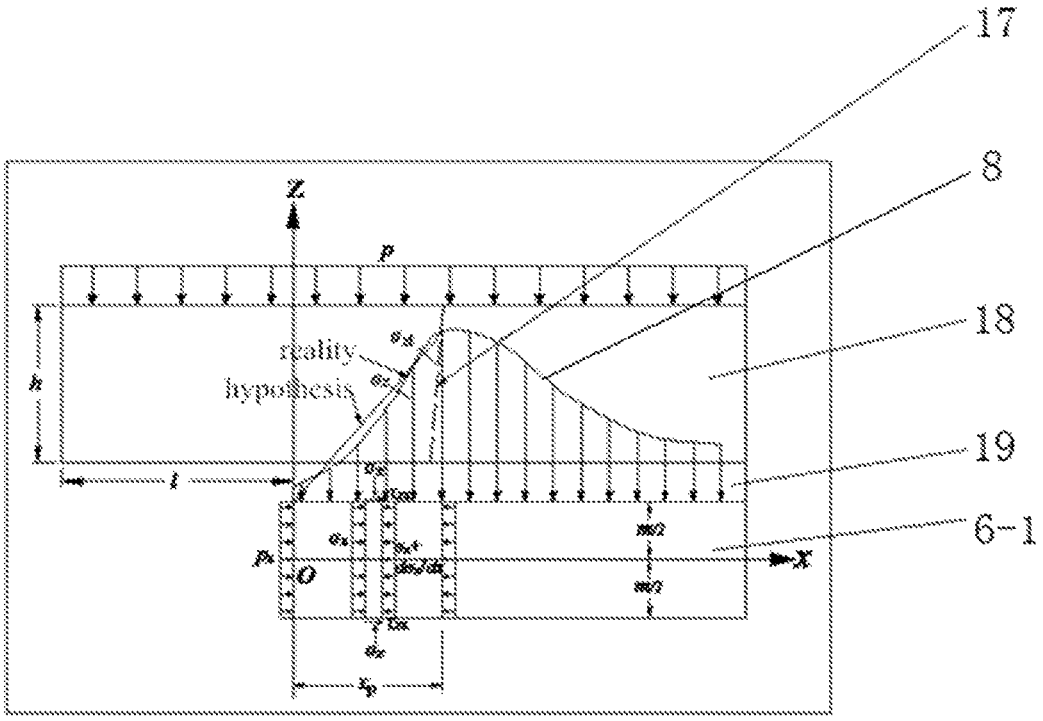
Figures 1, 5:
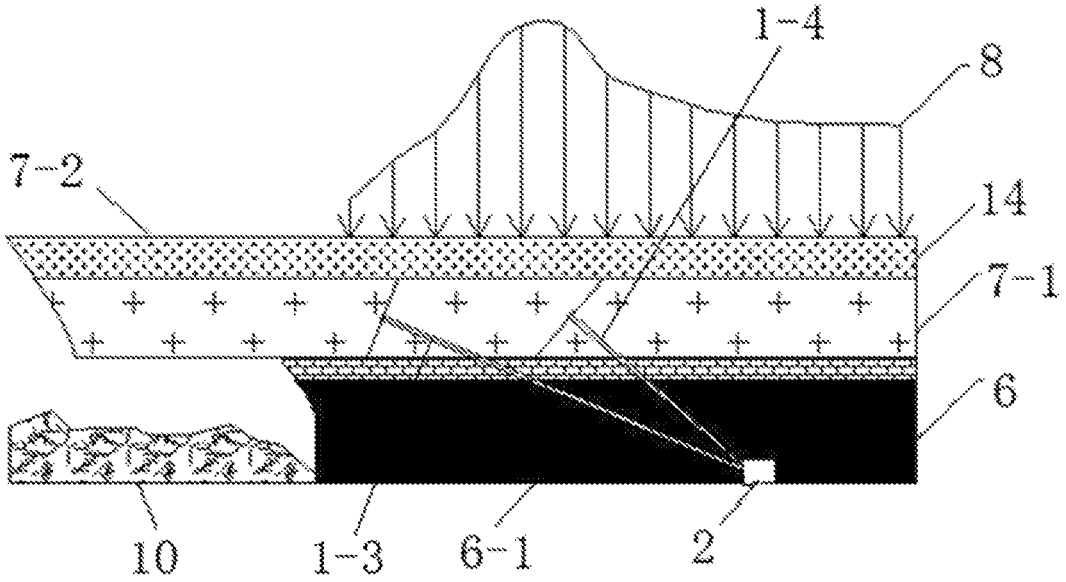
Figures 2, 5:
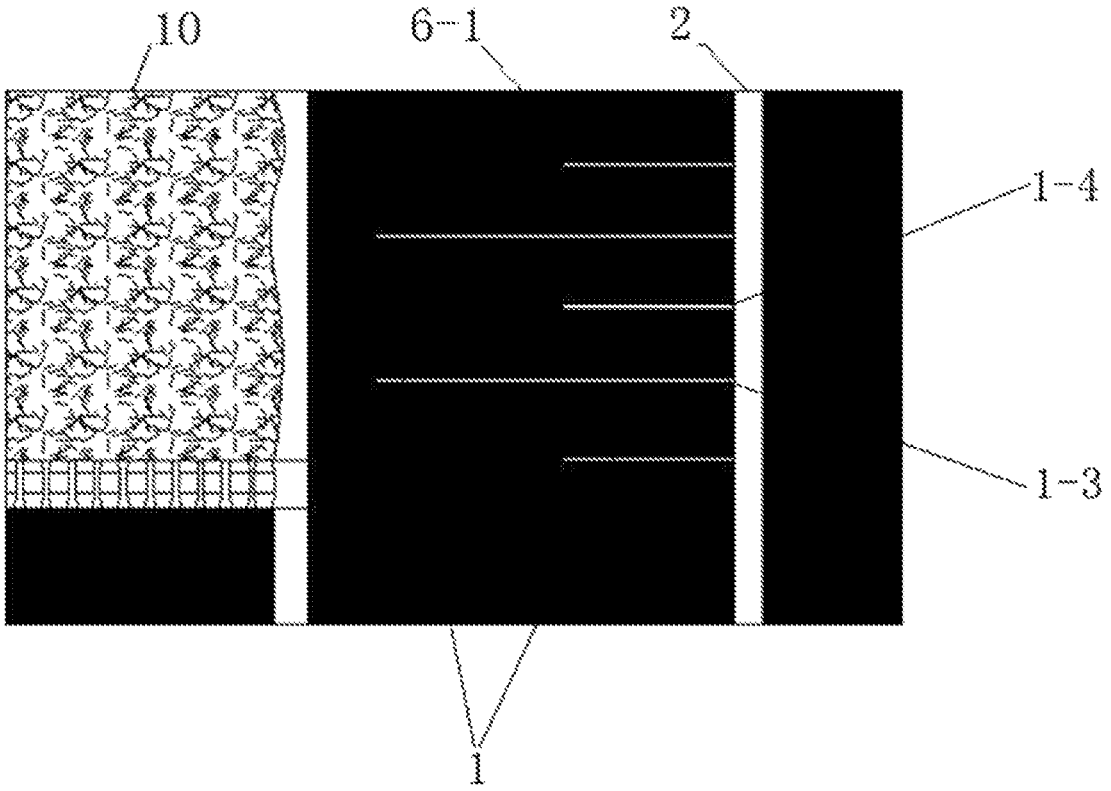
Figures 1, 6:
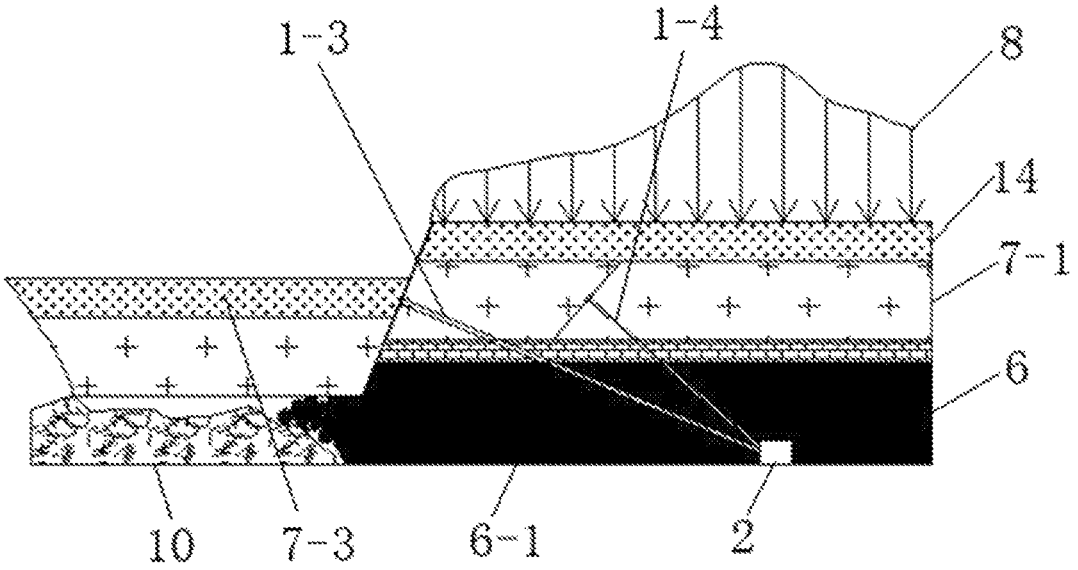
Figures 2, 6:
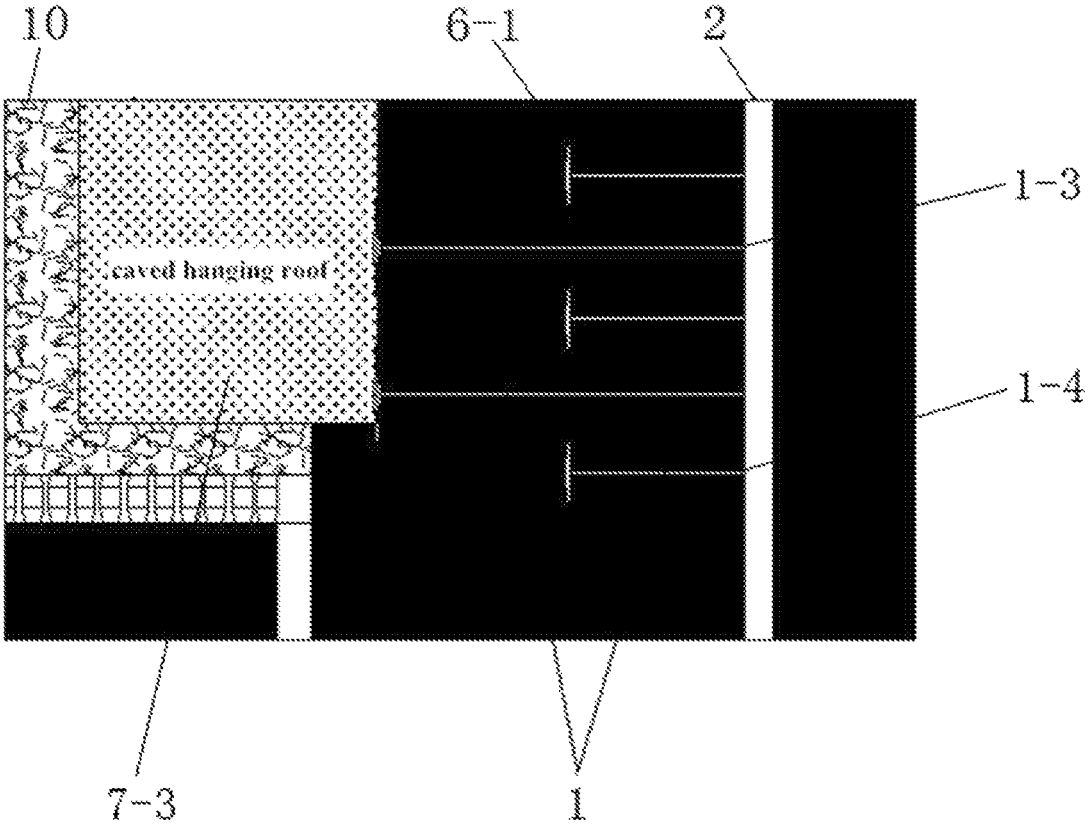

Referring to the FIG. 4, the breaking plane of the hard roof-cutting is named as top-cutting line and the optimum position of it is the boundary line between the fracture zone and the plastic zone of the coal pillar. The specific calculation formula is as follows:

$$x_m = \min\left(\begin{array}{c} \frac{1}{4}\frac{\lambda m}{\tan\varphi_0}(M\gamma_c H + Y)\ln \\ \left(\frac{M\gamma_c H + Y + c_0\cot\varphi_0}{\frac{\frac{D}{2}(q_n)_l + (H+h)(l+a)\gamma}{a} + \gamma_0 h_0 + c_0\cot\varphi_0}\right) + \\ \frac{\frac{D}{2}(q_n)_l + (H+h)l\gamma}{M\gamma_c H + Y - (H+h)\gamma - \gamma_0 h_0}, \\ \frac{\left[\frac{D}{2}(q_n)_l + l\gamma(h+H)\right]\sin\alpha}{2\tau_0 - [\gamma_0 h_0 + \gamma(h+H)]\sin\alpha} \end{array}\right)$$

In the formula, $$M = \frac{(2+b)+(2+3b)\sin\varphi}{(2+b)(1-\sin\varphi)},\ Y = \frac{4(1+b)c\sin\varphi}{(2+b)(1-\sin\varphi)},$$

$$(q_n)_l = \frac{Eh^3(\gamma h + \gamma_1 h_1 + \ldots + \gamma_n h_n)}{Eh^3 + E_1 h_1^3 + \ldots + E_n h_n^3}$$

wherein, the H is the buried depth (m) of the hard hanging roof; the D is the horizontal span (m) between the hanging roof at one side of the gob and that at another side of the gob. The a is the width (m) of the coal pillar; the l and the h are the length (m) and the thickness (m) of the roof cantilever beam relatively; the E is the elastic modulus (GPa); the E1, E2, E3, . . . En are relatively the elastic modulus of the overlying burden which are close to the main roof; the $\gamma$ is the bulk density (MN/m3), the $\gamma 1$, $\gamma 2$, . . . $\gamma n$ are relatively the bulk density of the overlying burden which are close to the main roof, the $\gamma c$ is the bulk density of the coal seam; the h0, $\gamma 0$ are relatively the thickness (m) and the bulk density (MN/m3) of the immediate roof; the c0, $\varphi 0$ are relatively the cohesive strength (MPa) and the internal friction angle (°) of the coal seam interface; the m is the height (m) of the coal seam; the c, $\varphi$, v are relatively the cohesive strength (MPa), the internal friction angle (°) and the Poisson ratio; the b is the unified parameters of the strength criterion which indicate the influence of the intermediate principal stress on the yield and the failure of the material and is equal to 7 ($0 \le b \le 1$); the $\lambda$ is the coal seam coefficient of the horizontal pressure, $\lambda = v/(1-v)$; the load of the main roof overlying strata to the rock beam of hard main roof is the (qn)l where the n means n layers of strata.

Referring to the FIG. 5-1, FIG. 5-2, FIG. 6-1 and FIG. 6-2 of the drawings, along the tunnel, rows of the long boreholes and the short boreholes are drilled into the hard roof with some space. The vertical components of this boreholes are up to the center of the hard roof. The long holes whose angle of elevation is small and whose end is closer to the side of gob but more far away from the tunnel have a big length. Relatively, the short holes whose angle of elevation is big and whose end is closer to the tunnel but more far away from side of the gob have a small length. The long holes whose ends are set in linear layout are the main fracturing holes. Similarly, the short holes whose end are set in linear layout are the assisting fracturing holes. All the holes are continuously set with some space along the tunnel in the order of the long-the short-the long. The pre-slotting is performed firstly and the fracturing is conducted secondly in the holes. The slotting and the fracturing could create a fracture arc which is called 'the long hole fracture arc' in the main fracturing holes and 'the short holes fracturing arc' in the assisting fracturing holes. The long hole fracture arc is used to cut off the rock strata of the hard roof and the short hole fracture arc is utilized to prevent the impact energy caused by the break of the roof from influencing the tunnel.

Some roofs may be particularly hard in some mines. They would hang there and don't want to collapse after recovery. Such roofs could be fractured after recovery. Also, such roof could be fractured before the recovery according to the reasonable design to form the fracture plane and the fractured roofs would collapse under the influence of gravity by themselves after the recovery, avoiding the hard roof-hanging.

When there are two layers or multilayer of the hard roof, each layer of the hard roof is conducted a row of long-short boreholes whose vertical components is in the center of the roof. The same kinds of the boreholes aiming at the same layer of the rock have the same horizontal length. That is, the 1-1 high level boreholes are drilled into the high level hard roof and the 1-2 low level boreholes are drilled into the low level hard roof. The fracturing to the targeted stratum could stop the stress wave induced by the recovery from transferring to the targeted surrounding rock.

Figures 1, 7:
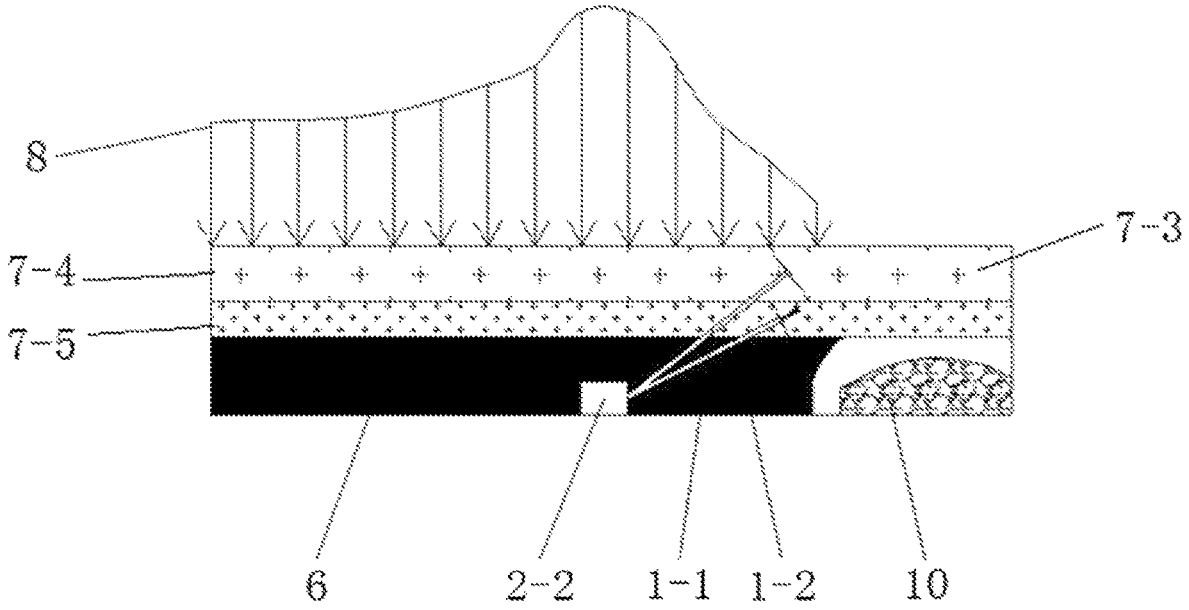
Figures 2, 7:
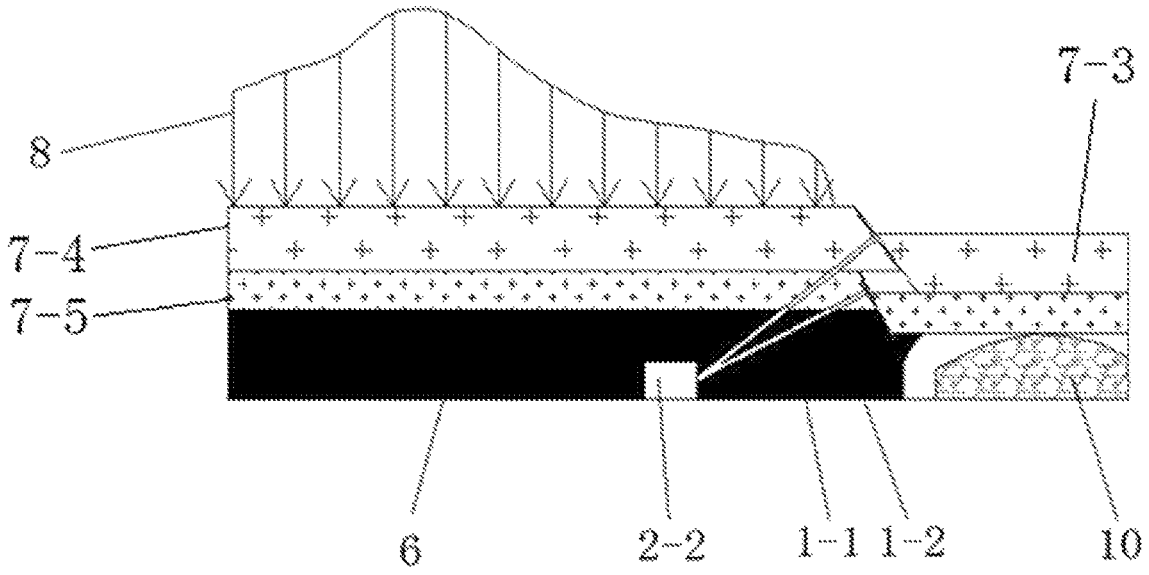

Referring to the FIG. 7-1 and the FIG. 7-2, when there are two layers of hard roof or multilayer of hard roof, a group of holes is respectively constructed to fracture each layer of them. The number of the borehole layers depends on the number of roof layers and it is the same group of borehole arrangement parameters for the boreholes prepared for the same layer of hard roof. Similarly, the vertical component of the boreholes is up the center of the hard roof. Such slicing fracturing for the multilayer of hard roof make the entire hard roof form layered failure.

2. Stress Interruption

Firstly, there is usually a high stress in the deep mines. Under the influence of the far field stress, the stress of the surrounding rock in the tunnel would gradually rise as time goes on. Secondly, the surrounding rock of the tunnel may be influenced by the mining-induced stress or other disturbance of its own face as well as the mining-induced stress of the neighbor faces during the tunnel conduction and tunnel maintenance, whose stress would obviously rise within the range of the influence. Especially, when the tunnel extraction face meets with the neighbor recovery face, the dynamic load coefficient could increase by several or tens of times which induce the strong ground pressure behavior. Thirdly, when the tunneling face meets the geological tectonic zone or the tunnel maintained is in the geological tectonic zone, the stress would highly concentrate, which might make the strong ground pressure behavior and serious deformation.

Firstly, for the tunnel with rising stress in the surrounding rock caused by the deep in-situ stress, a closed and rounded narrow fracture zone or plane should be formed in the periphery of the tunnel. So, just after the tunneling complete, the stress transfer from the far filed to the tunnel should be prevent by the cutting and interruption circle as early as possible. Secondly, for the tunnel with rising stress caused by the mining recovery or the geological tectonic zone, the stress transfer should be stop. The location and the propagation path of the stress source should be targeted and the rock strata which transfer the stress should be specially fractured to form narrow fracture zone or fracture plane, namely, the cutting and interruption circle or the cutting and interruption arch by which the stress could be prevent from transmitting. In the long wall mining, the neighbor mining face usually transfer the dynamic load to the tunnel through the roof above the coal pillar; the upper mining face usually transfer the dynamic load to the tunnel through the upper roof; its own face usually transfers the dynamic load to the tunnel through the roof of the mining face side; the inclined coal seam or the steeply inclined coal seam mainly transfer the dynamic load to the tunnel through the floor. Thirdly, for the tunnel with rising stress caused by the geological tectonic structure, the rock strata between the structure and the tunnel should be cut off to form the fracture plane which stop the stress transfer.

The integrated rock stratum with middle hardness in the roof is usually the key stratum to propagate the high stress. Referring to the FIG. 1, FIG. 2-1 and FIG. 2-2, for this key stratum, specially targeted roof should be fractured to form the fracture zone. The high stress of the floor mainly comes from the axis of the fold, the tectonic stress (in the FIGS. 2-3, 2-4, there are syncline structure and anticline structure. The stress concentrate in the floor just as the stress line showed) as well as the floor of the inclined coal seam during the mining recovery (in the FIG. 2-5, FIG. 2-6, the main influence factor is the mining recovery face. The stress concentrate in the floor just as the stress line showed). Referring to the FIG. 2-2, FIG. 2-4 and FIG. 2-6, specifically, the boreholes are drilled into the targeted surrounding rock in the tunnel, whose vertical component is up to the center of the targeted surrounding rock. The targeted surrounding rock may be the roof, the floor or the tunnel's sides (for example, it is the roof in the FIG. 2-1 and FIG. 2-2 or the floor in the FIG. 2-3, FIG. 2-4, FIG. 2-5 and FIG. 2-6). After the fracturing in the boreholes, the cracks connect with each other to form the cutting and interruption circle or the cutting and interruption line by which the high stress transmitting to the tunnel is artificially prevented.

3. Stress Yielding

Figure 8:
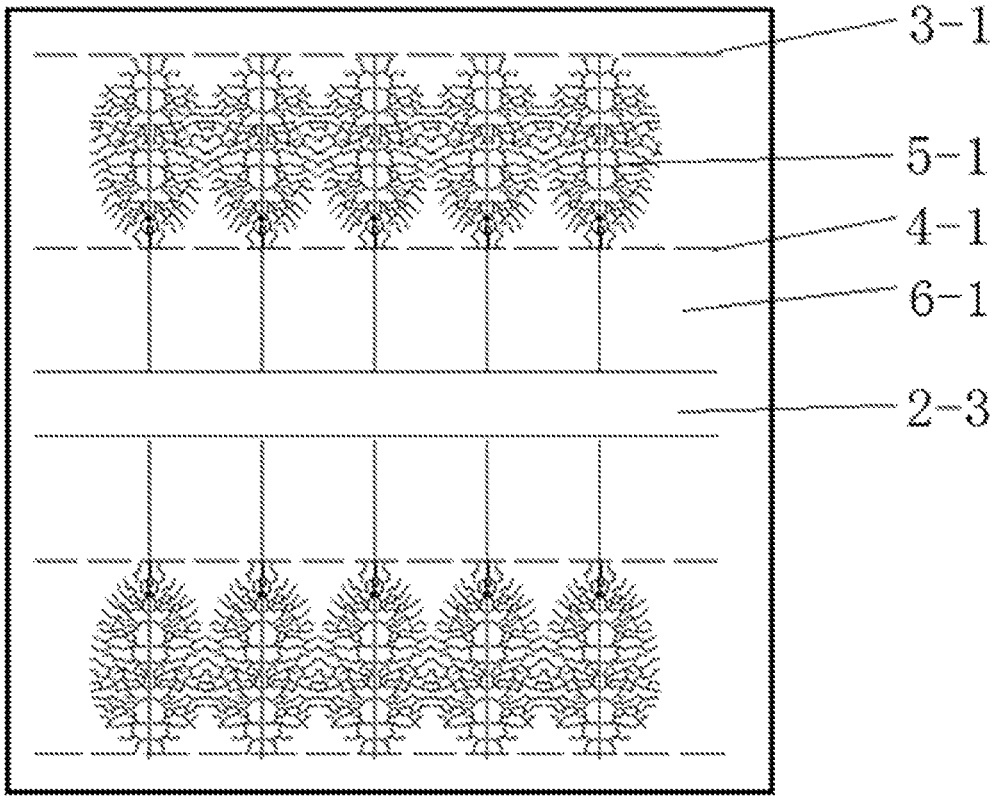
FIG. 8 shows an embodiment which drills the boreholes on the two sides and performs fracturing to transfer the stress.
Figure 9:
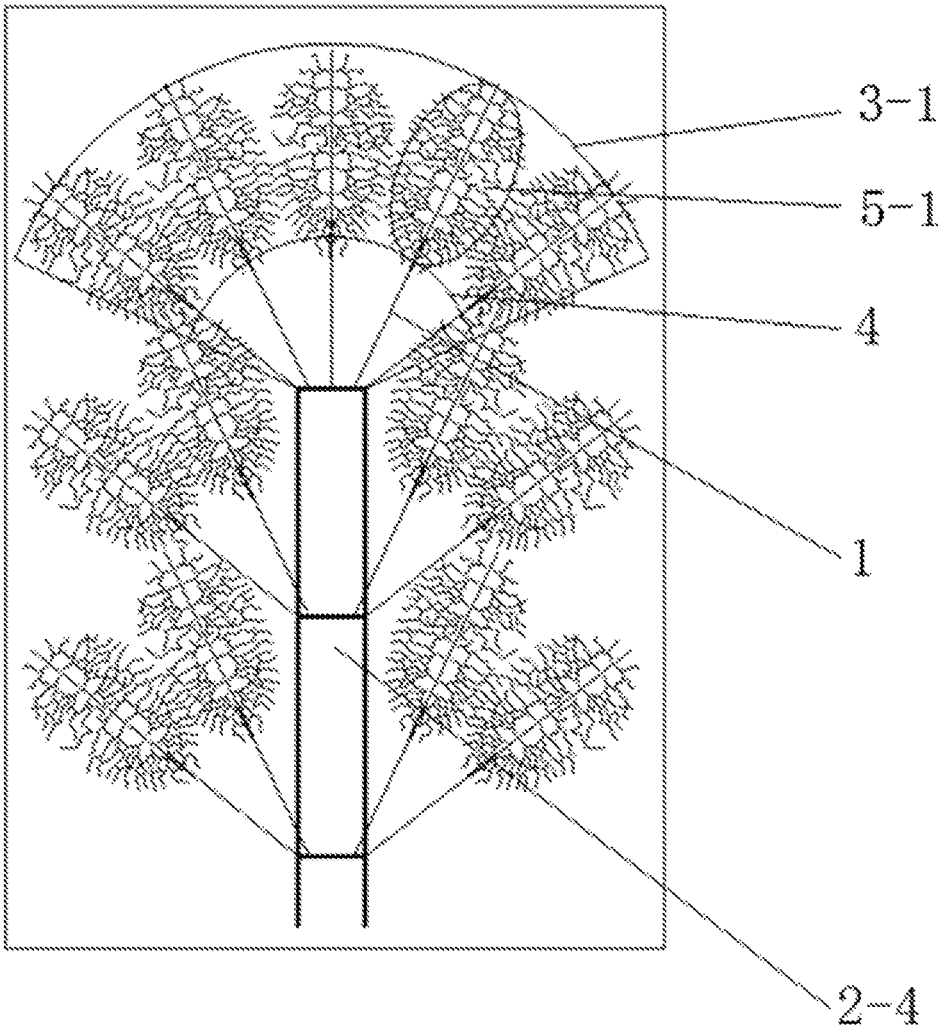
FIG. 9 shows an embodiment which drills the boreholes on the driving face of the excavating tunnel and performs fracturing to transform the stress.

Referring to the FIG. 1, FIG. 8 and FIG. 9, for the deep mine tunnel with high stress or the tunnel influenced by the geological tectonic high stress, the boreholes are drilled into the surrounding rock in the tunnel and then the fracturing artificially form a circle of weaken zone named fracturing ring. The fracturing ring is the weaken zone with some width. Considering the practical situation of the engineering, the distance between the fracturing ring and the tunnel could not be too small or the integrity of the support body of tunnel and the surrounding rock would be damaged. The inner boundary of the fracturing ring is the protective circle. The fracturing within the range of the fracturing ring guide the high stress to transfer to the deeper far zone, which make the tunnel and the integrated surrounding rock within the protective circle and the surrounding rock of the tunnel in the state of a low stress. The range of the protective circle is related to the tunnel's shape, the surrounding rock condition, the ambient in-site stress and the support parameters. Referring to the FIG. 3, FIG. 4, FIG. 5, FIG. 6, and FIG. 7, on one hand, when there is no hard hanging roof, the stress of the tunnel could not be released by the cutting and interruption circle; on the other hand, the propagation of the mining induced stress could not be proactively prevented by the cutting and interruption circle or the deep tunnel has been in the state of high stress as the FIG. 2 shown; for those situation, the method named stress yielding that guide the high stress to deeper or other area could be conducted. The FIG. 8 shows the boreholes drilled into the tunnel's sides in the excavation completed tunnel. The depth of the boreholes reaches to the outer boundary of the fracturing ring which is the outer boundary of the fracture zone in the top view. The cutting and interruption arch is designed according to the tunnel's shape, surrounding rock condition, ambient in-situ stress condition and the support parameters. Every borehole is sealed at the position of the protective circle which is the protective line in the top view so that the borehole part between the bottom and the sealed position could be fractured. The parts on the two sides of the tunnel are, from the tunnel to the distance, the coal pillar, the protective line and the fracture zone. The weaken structure zone between the stress interruption line and the protective line could achieve the stress shadowing. The FIG. 9 shows the boreholes drilled towards the direction of the heading at the excavation face of the tunnel. The fan drillings are conducted in the direction of the heading and two sides near the excavation face, whose length reach to the outer boundary of the fracture circle. The outer boundary of the fracture circle is calculated on the drawings basing on the radius of the protective circle and the width of the weaken zone, which is related to the tunnel's shape, surrounding rock condition, ambient in-situ stress condition and the support parameters. Every borehole is sealed at the position of the protective circle so that the borehole part between the bottom and the sealed position could be fractured. According to the tunnel's shape, surrounding rock condition, ambient in-situ stress condition and the support parameters, the safety coal pillar should be reserve for the fracturing with some width which is usually 3~10 m. The existence of the fracturing ring forms an artificial weaken zone in the periphery of the tunnel on the premise of that there is no damage of the tunnel surrounding rock as well as the tunnel support body and the surrounding rock is stable and reliable, which proactively transfer the high stress to the external of the fracture ring to make the tunnel in a low stress state.

For those stress transfer methods, the fracturing methods includes hydraulic fracturing, gas fracturing, CO2 phase-transition fracturing, electromagnetic pulse fracturing, capsule-expanding fracturing and bolts-expanding mechanical fracturing. The cost of the pre-slotting hydraulic fracturing technology is relatively low on the whole. The cost of the pre-slotting hydraulic fracturing technology is no more than one-tenth of that of the dynamite blast if they are used to deal with the same quantities of the hard roof. After the pre-slotting hydraulic fracturing, there is no ground pressure behavior, which guarantee the mine production safety. If the number of the damaged single prop whose purchase and installation cost is 2000 RMB hypothetically take 30 in one time of ground pressure behavior, the Tongxin mine of Datong coal mine group, whose 5105 tunnel avoid 20 times of the ground pressure behavior, reduce the loss of 1 million 1200 thousand RMB for one tunnel by using the stress transfer method. Also, the delay influence of the forepoling tunnel maintenance to the normal production of the recovery working face is reduced, which increase the single working face production by 500 thousand tons of raw coal and create the benefit of about 93 million 200 thousand RMB.

As described above, it is only a better example of the invention, not any restriction of form on the invention. According to the essence of the invention, any simple modification and the same changes made to the above embodiments are within the scope of protection of the invention.

What is claimed is:

1. A stress-transfer method in a tunnel comprising:

drilling holes from the tunnel towards a targeted surrounding rock surrounding the tunnel, wherein a horizontal portion of an extending direction of each of the holes directs from the tunnel to a gob; and fracturing the holes to create a fracturing ring;

wherein an inner boundary of the fracturing ring defines a protective circle and a radius of the protective circle keeps a certain width from an edge of a support body of the tunnel to reserve safety coal pillar barriers.

2. The stress-transfer method in the tunnel according to claim 1, wherein to get a wide fracturing ring, the fracturing is performed throughout the holes; or to get a narrow fracturing ring defining a cutting and interruption circle, a pre-slotting is further performed followed by the fracturing conducted at bottoms of the holes.

3. The stress-transferethod in the tunnel according to claim 2, wherein a vertical position of the bottom of the hole is located in the targeted surrounding rock; the targeted surrounding rock comprises a roof, a floor, a sidewall or a combination thereof, and a width of the fracturing ring is adjusted by changing fracturing lengths of the holes.

4. The stress-transfer method in the tunnel according to claim 3, wherein when one layer or multilayer of hard rock stratum exists in the roof, a pillar with a certain width exists between the tunnel and the gob, the holes are drilled at an angle into the roof having the hard rock stratum from the tunnel, a location of an end part of the hole reaches to the pillar with certain distance in a horizontal direction, a location of the end part of the hole in a vertical direction is located at a center of the roof; and the holes are pre-slotted to generate an initial slot and fractured to form fractures, wherein the initial slot is induced along a direction of a fracture initiation;

the fractures propagate and extend along several directions to form a fracture plane consisting of one or multiple cracks whose center is at end parts of the holes;

the holes are set along an axis of the tunnel at a certain intervals to be drilled and fractured;

the cracks created by fracturing connect with each other or neighbor with each other to cut off the roof having the hard rock stratum at a roof-breaking line; and the roof-breaking line is positioned at a boundary line between a plastic zone and a crushing zone of the pillar.

5. The stress-transfer method in the tunnel according to claim 4, wherein both long holes and short holes are drilled in rows along the axis of the tunnel into the roof having the hard rock stratum, vertical positions of ends of both the short holes and the long holes are located at the center of the roof having the hard rock stratum, wherein the long holes have a small angle of elevation and long length, and are closer to a side of the gob and more far away from the tunnel; the short holes have a large angle of elevation and short length, and are more far away from side of the gob and closer to the tunnel; the ends of the long holes, arranged linearly, are main fracturing holes; the ends of the short holes, arranged linearly, are assisting fracturing holes; the holes are continuously staggered set with some space along the tunnel in an order of long- short-long-short; the pre-slotting is performed firstly and the fracturing is conducted secondly in the holes, the pre-slotting and the fracturing create a long holes fracture arc in the main fracturing holes and a short holes fracturing arc in the assisting fracturing holes, the long holes fracture arc is used to cut off rock strata of the roof and the short holes fracture arc is utilized to prevent an impact energy caused by a break of the roof from influencing the tunnel.

6. The stress-transfer method in the tunnel according to claim 4, wherein when there are two or more layers of hard roofs, a group of holes is respectively constructed to fracture each layer of the hard roofs, a number of groups of the holes corresponds to a number of the layers of the hard roofs, the holes for each layer of the hard roofs are arranged in an identical manner, and ends of the holes in the vertical direction are at respective centers of respective hard roofs.

7. The stress-transfer method in the tunnel according to claim 2, wherein the holes are sealed; and bottoms of the holes are pre-slotted and fractured to form a narrow fracture zone or the cutting and interruption circle to prevent the high-stress from transmitting towards the tunnel to achieve the stress-transfer, wherein the pre-slotting and fracturing is conducted at an early stage of forming the tunnel, before an influence of a front abutment pressure on the tunnel or in the tunnel influenced by the tectonic high-stress.

8. The stress-transfer method in the tunnel according to claim 2, wherein the holes are sealed and fractured to form the fracturing ring with some width, wherein the fracturing ring transmits a high stress to farther zones to form the protective circle, the tunnel and an integrated surrounding rock of the protective circle is in a low-stress zone to avoid the high-stress, and the drilling is conducted in the tunnel influenced by the high-stress of deep mines or tectonic zones.

9. The stress-transfer method in the tunnel according to claim 8, wherein the holes on the sides of the tunnel are drilled to weaken zones within the fracturing ring in the whole tunnel, also, a sector drilling on a tunnel driving face is conducted in a heading direction to weaken front zones within the fracturing ring; and a protective pillar with a width of 3~10 meters is reserved at a borehole section near the tunnel when fracturing.

10. The stress-transfer method in the tunnel according to claim 1, wherein the fracturing includes hydraulic fracturing, gas fracturing, $CO_2$ phase-transition fracturing, electromagnetic pulse fracturing, capsule-expanding fracturing and bolts-expanding mechanical fracturing.

* * * * *